US010590663B1

(12) United States Patent
Meeks

(10) Patent No.: US 10,590,663 B1
(45) Date of Patent: Mar. 17, 2020

(54) CLAMPS FOR INSTALLING SIDING

(71) Applicant: Jordan Forest Products, LLC, Mt. Gilead, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 0 days.

(21) Appl. No.: 16/052,438

(22) Filed: Aug. 1, 2018

Related U.S. Application Data

(60) Provisional application No. 62/547,160, filed on Aug. 18, 2017.

(51) Int. Cl.
*E04F 21/18* (2006.01)
*E04F 13/08* (2006.01)

(52) U.S. Cl.
CPC ..... *E04F 21/185* (2013.01); *E04F 13/0864* (2013.01); *E04F 21/1833* (2013.01); *E04F 21/1844* (2013.01); *E04F 21/1855* (2013.01); *E04F 21/1877* (2013.01)

(58) Field of Classification Search
CPC . E04F 13/0864; E04F 21/1855; E04F 21/185; E04F 21/1844; E04F 21/1877; E04F 21/1883; Y10S 269/904; Y10S 52/01; E04G 21/16; G01B 3/30
See application file for complete search history.

(56) References Cited

U.S. PATENT DOCUMENTS 390,459 A * 10/1888 Davis ..... E04F 21/1855 33/646
774,114 A * 11/1904 Spear ..... B25H 7/04 33/411
1,031,854 A * 7/1912 Keyes ..... E04F 21/1855 33/646
3,792,852 A * 2/1974 Reniker ..... E04F 21/1855 269/95
4,155,175 A * 5/1979 Stiles ..... G01B 3/30 33/646
4,164,346 A 8/1979 Sickler ..... 269/321
4,314,429 A 2/1982 Casteel et al. ..... 52/127
4,425,714 A * 1/1984 Kelly, Jr. ..... E04F 21/1855 33/646
4,484,392 A 11/1984 DeFino et al. ..... 33/187
4,654,975 A * 4/1987 Lopez ..... B25C 7/00 33/626
5,203,090 A * 4/1993 Bouska ..... E04F 21/1855 33/33

(Continued)

*Primary Examiner* — Adriana Figueroa
*Assistant Examiner* — Jessie T Fonseca
(74) *Attorney, Agent, or Firm* — MacCord Mason PLLC

(57) ABSTRACT

A clamp for installing a siding onto a building. The clamp comprises an upper frame having a nail for mounting the clamp onto the building and a lower frame having a top end pivotally connected to a lower end of the upper frame with a hook at an opposing end of the lower frame for holding a bottom of the siding. A spring is included biasing the lower frame with respect to the upper frame to angle the lower frame away from the building. In operation, the clamp is mounted onto the building and the hook is aligned to a position wherein the siding is to be installed, whereby the bottom of the siding may be placed on the hook and mounted onto the building.

16 Claims, 5 Drawing Sheets

(56) References Cited

U.S. PATENT DOCUMENTS

| | | | | |
|---|---|---|---|---|
| 5,465,499 | A | 11/1995 | LaPlante | 33/647 |
| 5,692,311 | A * | 12/1997 | Paquin | E04D 15/04 33/647 |
| 7,124,551 | B1 | 10/2006 | Patera | 52/749.1 |
| 7,610,734 | B2 | 11/2009 | Edwards et al. | 52/749.11 |
| 2004/0221467 | A1* | 11/2004 | Chillington | E04D 15/025 33/649 |
| 2007/0256385 | A1* | 11/2007 | Walda | E04F 21/1855 52/545 |
| 2008/0106021 | A1* | 5/2008 | Simko | E04F 21/1855 269/289 R |
| 2008/0301966 | A1 | 12/2008 | Walther | 33/649 |
| 2009/0107084 | A1* | 4/2009 | Hutchings | E04F 21/1855 52/748.1 |

* cited by examiner

CLAMPS FOR INSTALLING SIDING

CROSS-REFERENCE TO RELATED APPLICATIONS

This application claims the benefit of U.S. Provisional Patent Application No. 62/547,160 filed Aug. 18, 2017, which is incorporated herein by reference in its entirety.

BACKGROUND OF THE INVENTION

The present invention relates to a clamp for installing siding. Exterior siding is a popular option for improving the appearance of a home or other building. Siding may come in many options, such as natural or composite wood, fiber cement, or vinyl. Each siding board typically measures between 12 to 16 feet in length, and may weigh between 12 to 28 pounds. During installation, each row of siding overlaps the row below it by some measured distance, such as about 1¼".

Desirably, the finished installation should have the rows of siding parallel with one another and with consistent overlap and exposure. However, at least two individuals are typically required to properly install siding because the boards must be properly aligned to achieve the desired parallel mounting. A single individual cannot hold a board in the correct position while measuring and/or fastening it to a house. Even with multiple people, slight yet noticeable deviations are common with siding installations. There are some tools available that enable a single individual to install siding, but these existing tools do not provide the ease of making adjustments to properly align the boards.

Thus, applicant wishes to provide a method and tool for installing siding that is easily mounted and adjustable while mounted to properly align siding, while at the same time, enable the installation to be performed by a single individual without requiring the assistance of others.

SUMMARY OF THE INVENTION

The present invention fulfills one or more of these needs in the art by providing a clamp for easily installing siding onto a building without requiring the assistance of a second individual. In one embodiment, the clamp comprises an upper frame having a nail for mounting the clamp onto the building and having a lower end, a lower frame having a top end pivotally connected to the lower end of the upper frame, and a hook at an opposing end of the lower frame. The hook is adapted for holding a bottom of the siding. A spring is included that biases the lower frame with respect to the upper frame to angle the lower frame away from the building. When the clamp is mounted onto the building and the hook is aligned to a position wherein the siding is to be installed, a bottom of the siding may be placed on the hook and thereby be at a suitable height to be mounted onto the building.

In one embodiment, the hook is height adjustable. A bolt is included on the hook and a slot is included on the lower frame for receiving the bolt, wherein the height of the hook can be adjusted by sliding the bolt along the slot of the lower frame. The slot may be substantially vertical. For example, the slot may span at least one-fourth of a length of the lower frame.

The clamp may further include a stop installed onto the bolt to affix the height of the hook along a position on the slot. In one embodiment, the stop comprises a wingnut installed onto a set of threadings on the bolt, whereby the height of the hook can be fixed by tightening the wingnut and the height of the hook can be adjusted by loosening the wingnut to move the bolt along the slot of the lower frame. In another embodiment, the stop comprises a thumbscrew fastener inserted through a boss on the lower frame and into a recess on the bolt, whereby the height of the hook can be adjusted by rotating the thumbscrew fastener to move the bolt along the slot of the lower frame. The thumbscrew fastener may be parallel to the slot and the lower frame.

In another embodiment, the clamp comprising an upper frame having a nail for mounting the clamp onto the building, a lower frame having a top end pivotally connected to a lower end of the upper frame, and a hook connected to a slot in the lower frame enabling the hook to slide along a length of the lower frame for adjusting a height of the hook. A spring is included that biases the lower frame with respect to the upper frame to angle the lower frame away from the building. When the clamp is mounted onto the building and the hook is aligned to a position wherein the siding is to be installed, a bottom of the siding may be placed on the hook and thereby be at a suitable height to be mounted onto the building.

The clamp may include a lever pivotally mounted onto the upper frame wherein the nail is installed into the lever. The clamp may further include a mounting hammer pad on one end of the lever and an unmounting hammer pad on an opposing end of the lever, with the nail installed underneath the mounting hammer pad. For example, the mounting hammer pad and unmounting hammer pad may be comprised of bronze hardened materials. In this embodiment, the clamp is adapted to be mounted by hammering the mounting hammer pad to insert the nail into the building and the clamp is adapted to be unmounted by hammering the unmounting hammer pad to remove the nail from the building.

In one embodiment, the clamp further includes a mounting spring installed onto a head of the nail and spanning down a length of a shaft of the nail onto a receiving cup on the upper frame. The mounting spring is adapted to insert the nail into the building by rotating the head of the nail in one direction and adapted to unmount the nail by rotating the head of the nail in the opposite direction.

The invention can also be considered as a method of installing a siding onto a wall of a building comprising mounting a first clamp onto the wall, mounting a second clamp a distance away from the first clamp, measuring a desired height for the siding, adjusting the height of a hook on the first clamp to match the desired height while the first clamp remains mounted, adjusting the height of a hook on the second clamp to match the desired height and the height of the hook on the first clamp while the second clamp remains mounted, placing a bottom of the siding onto the hooks of the first and second clamps, affixing the siding onto the wall, and unmounting the first clamp and the second clamp from the wall.

In one example, mounting one or more of the clamps onto the wall may comprise hammering a first hammer pad to drive a nail into the wall, and unmounting the clamp from the wall may comprise hammering a second hammer pad to remove the nail from the wall.

In another example, mounting one or more of the clamps onto the wall may comprise driving a nail into the wall, and unmounting the clamp from the wall may comprise pulling a head of the nail away from the wall.

In one example, adjusting the height of the hook of one or more of the clamps may comprise rotating a thumbscrew. In another example, adjusting the height of the hook of one or more of clamps may comprise rotating a wingnut in a direction to loosen the hook for height adjustment and rotating the wingnut in an opposite direction to affix the hook at the desired height.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
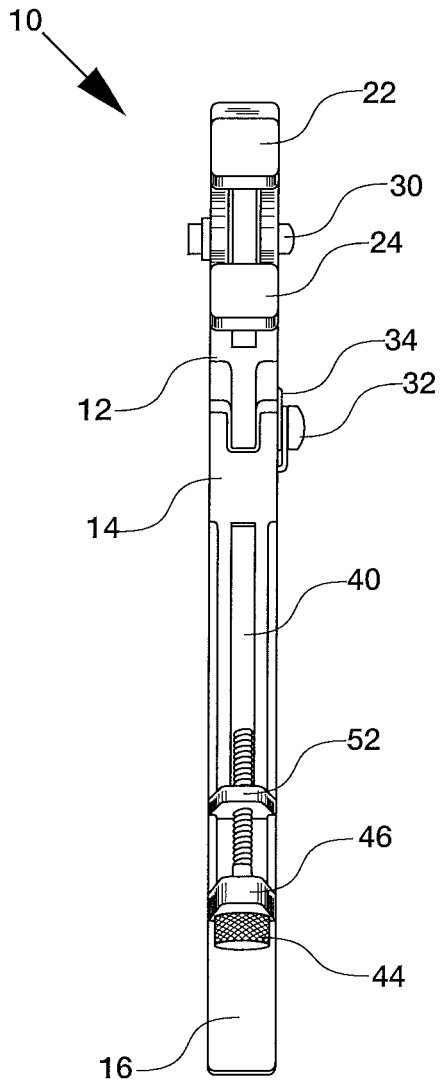
FIG. 1 is a front elevational view of a clamp constructed according to one embodiment.

FIG. 1 shows one embodiment of a clamp 10 having an upper frame 12 for mounting the clamp 10, a lower frame 14 angled away from the upper frame 12 to provide room for a siding board to be mounted between the lower frame 14 and the building wall 8, and a hook 16 adapted to hold the siding.

Figure 2:
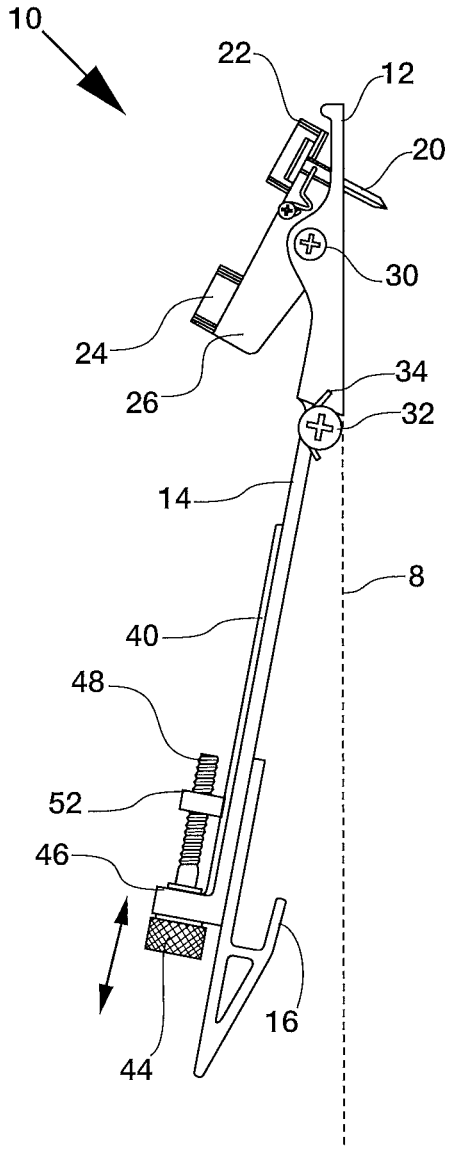
FIG. 2 is a side elevational view of the clamp shown in FIG. 1.

The upper frame 12 includes a nail 20 that is used to mount the clamp 10 onto an outer wall 8 of a building. The nail 20 may be in either a mounted position or an unmounted position. In the embodiment shown, the upper frame comprises a pivotable lever 26 with a mounting hammer pad 22 and an unmounting hammer pad 24. The nail 20 is positioned directly below the mounting hammer pad 22. As seen in FIG. 2, both hammer pads are placed on opposing ends of a lever 26, which is pivotally mounted onto the upper frame 12 via a pivot pin 30. The hammer pads are preferably constructed of a durable material to withstand repeated hammering. For example, the hammer pads may be constructed of a bronze hardened material. The nail 20 can take many forms, and in preferred embodiments is removable from lever 26, so it can be replaced in case of damage. Alternatively, it can be a permanent spiked element.

Figure 3:
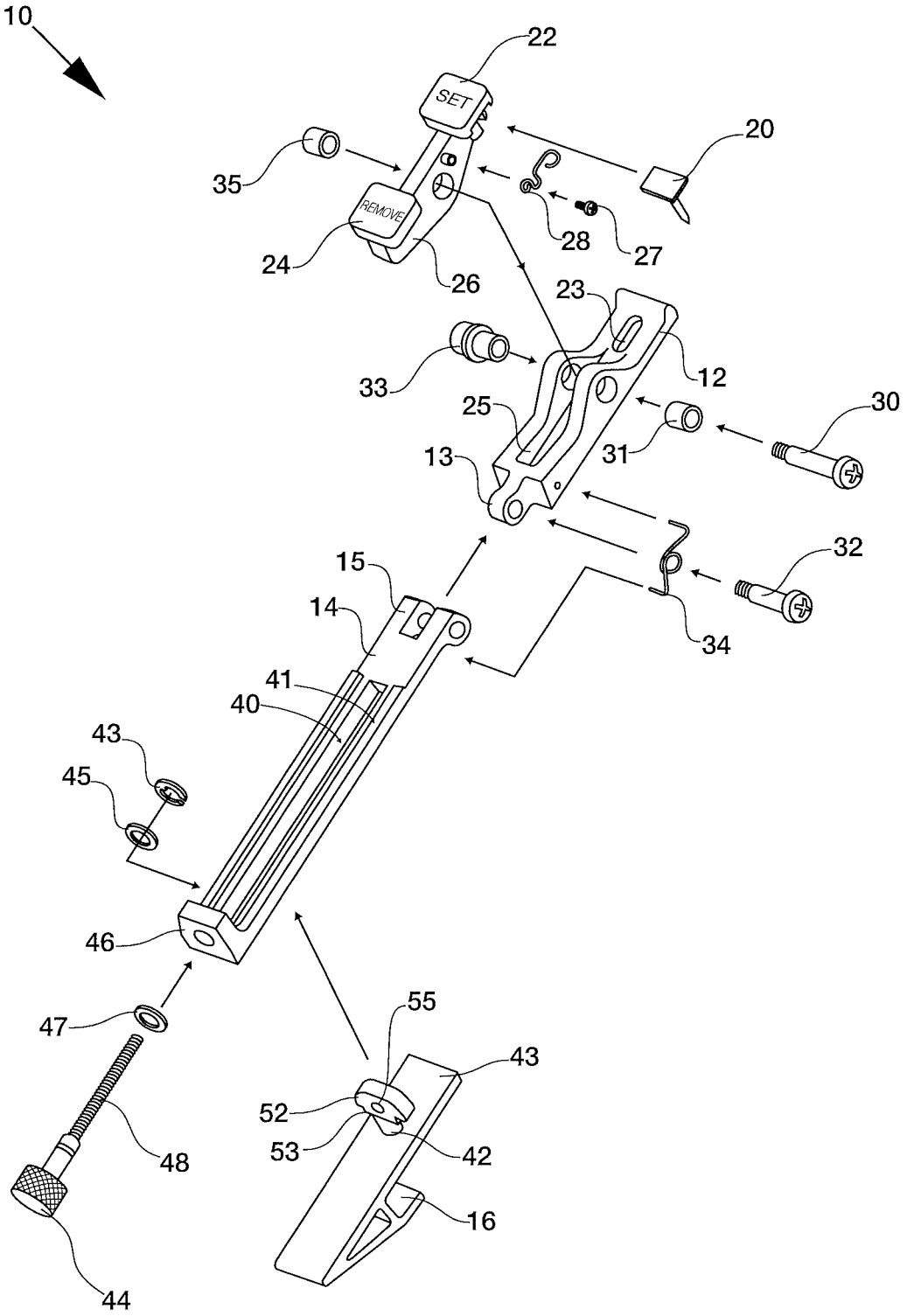
FIG. 3 is an enlarged exploded view of the clamp shown in FIG. 1.

FIG. 3 is an exploded view of the clamp 10 that depicts how various components may be assembled in the embodiment shown in FIGS. 1 and 2. The upper frame 12 includes slots 23 and 25 that enable lever 26 to pivot within upper frame 12. The nail 20 extends through slot 23 to transition between a mounted position and an unmounted position without being obstructed by the upper frame 12. When the mounting hammer pad 22 is depressed, then the nail 20 extends through the slot 23. Then, if the unmounting hammer pad 24 is depressed, then the nail 20 retracts from slot 23 and a portion of lever 26 resting below unmounting hammer pad 24 inserts through slot 25. The nail 20 is retained under the hammer pad 22 by a spring 28, wherein the spring 28 is fastened to lever 26 via fastener 27 positioned perpendicularly to the nail 20.

Pivot pin 30 enables the lever 26 to rotate and allow the nail 20 to transition between the mounted and unmounted positions. In the embodiment shown in FIG. 3, the pivot pin 30 may include a male threaded end that is inserted into a bushing 33 having a female-threaded recess. Bushings 31 and 35 may also be added.

The upper frame 12 includes a knuckle 13 that is inserted between the knuckles 15 of lower frame 14 to form a hinge when combined. The hinge formed from the upper and lower frames is connected via a pin 32, with the pin 32 being inserted into a spring 34. The spring 34 biases the lower frame 14 at an angle with respect to the upper frame 12. As shown in FIG. 2, angling the lower frame 14 creates a spacing between the hook 16 and a wall 8 when the clamp is mounted, so that a siding board can be easily inserted into the hook 16 behind the lower frame 14.

In the embodiment shown in FIG. 2, the hook 16 is a separate component attached to the lower frame 14 with a vertically adjustable position even while the clamp 10 remains mounted on wall 8. The hook 16 includes a plate 43 with a bolt 42 that is inserted through slot 40 found on the lower frame 14. The slot 40 extends vertically along at least a portion of the lower frame's length. A cap 52 having a threaded recess is included to retain the hook 16 on the lower frame 14. As seen in FIG. 3, one or more guide railings 41 may be included adjacent to the slot 40 to facilitate movement of the cap 52 along slot 40. The cap 52 may include shoulders 53 that fit into the guide railings 41.

The height of hook 16 may be fine-tuned using a thumbscrew 44. The thumbscrew 44 may be positioned parallel to the slot 40 and lower frame 14, and the bolt end 48 of the thumbscrew 44 is inserted through a boss 46 on the end of lower frame 14 and through a female-threaded recess 55 in the cap 52. A c-clip 43 may be added to hold the thumbscrew 44 in place. Washers 45 and 47 may also be added to each respective side of the boss 46.

The thumbscrew 44 may be rotated in a first direction to raise the hook 16. As the thumbscrew 44 rotates in the first direction, the bolt 48 stays stationary in the boss 46 with the cap 52 traveling along the bolt end 48 as the thumbscrew 44 is turned. Alternatively, the bolt can remain at a fitted position in the cap 52 and travel itself in the boss 46. In that case, the bolt 48 will continue to extend through until the knob of the thumbscrew 44 abuts the boss 46, wherein the maximum height of the hook 16 is reached. Conversely, rotating the thumbscrew 44 in an opposing direction will lower the hook 16. The bolt 48 will lower and the knob of the thumbscrew 44 will extend away from the boss 46, until the cap 52 abuts the boss 46 wherein the hook is dropped to its lowest height. Thus, the boss 46 also functions as a stop in conjunction with the cap 52 and knob of the thumbscrew 44 that defines the maximum and lowest height that the hook 16 can be adjusted. The length of the thumbscrew 44 may vary in other embodiments to modify the height range that the hook 16 can be adjusted.

Figure 4:
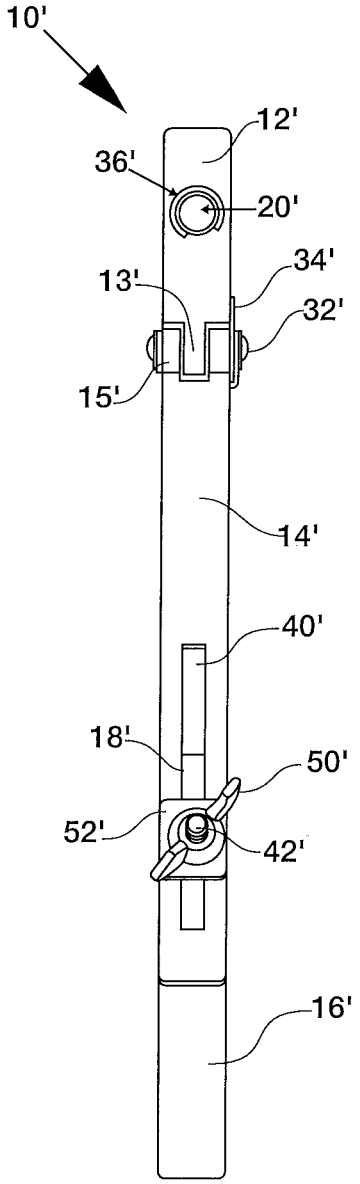
FIG. 4 is a front elevational view of a clamp constructed according to another embodiment.
Figure 5:
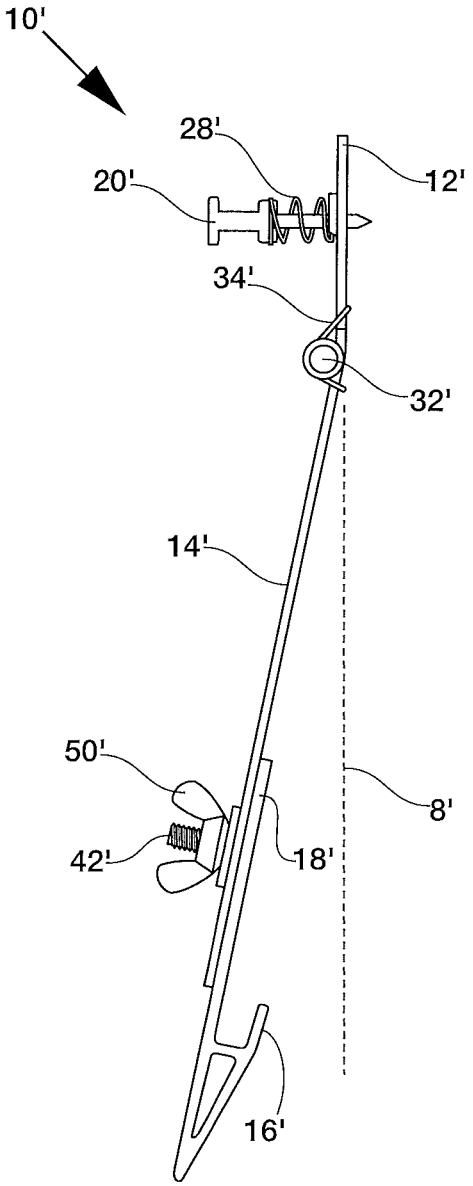
FIG. 5 is a side elevational view of the clamp shown in FIG. 4.
Figure 6:
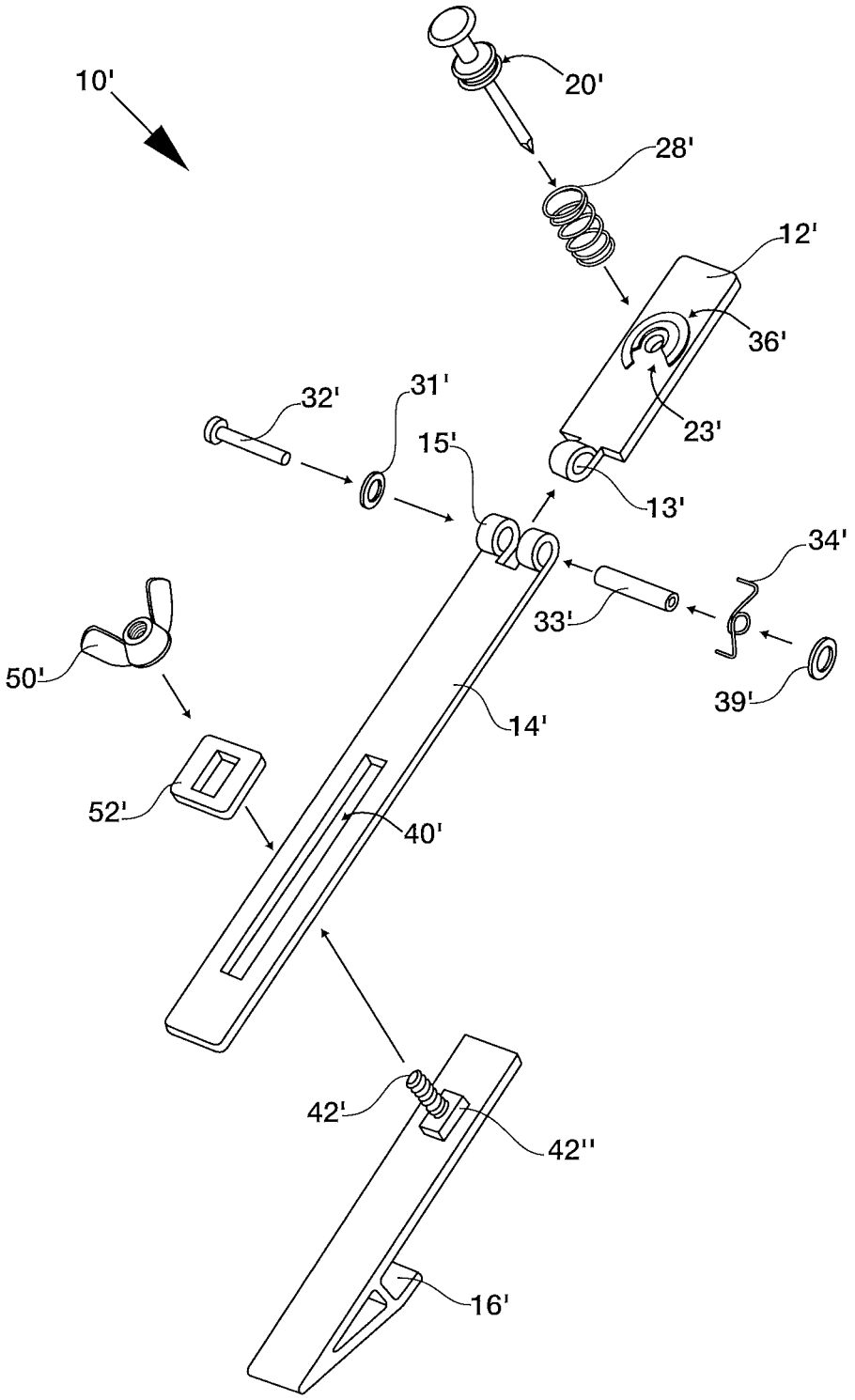
FIG. 6 is an enlarged exploded view of the clamp shown in FIG. 4.

FIGS. 4-6 show another embodiment of a clamp 10' having an upper frame 12' for mounting the clamp 10', a lower frame 14' angled away from the upper frame 12' to receive a siding board, and a hook 16' adapted to hold the siding board.

The upper frame 12' includes a double-headed nail 20' that is used to mount the clamp 10' onto an outer wall of a building. The nail 20' may have either a mounted position or an unmounted position. In the embodiment shown, the nail 20' includes a mounting spring 28' that spans along a portion of the nail's shaft below the bottom head. The mounting spring 28' may be attached at one end to the lower head of the nail 20'. The mounting spring 28' and a portion of the nail 20' are positioned on an exterior face of the upper frame 12'.

The other end of the mounting spring 28' is inserted into a cup 36' adapted for retaining a portion of the mounting spring 28' via a friction fit.

FIG. 6 is an exploded view of the clamp 10' that depicts how various components may be assembled in the embodiment shown in FIGS. 4 and 5. The upper frame 12' includes a hole 23' that enables the nail 20' to extend through and transition between a mounted position and an unmounted position without the pointed end of nail 20' being obstructed by the upper frame 12'. While the nail 20' remains in the unmounted position, the mounting spring 28' remains relaxed with minimal tension. The nail 20' may be driven in a first direction to transition from the unmounted position to a mounted position for affixing the clamp 10' onto a wall. As the nail 20' is driven in the first direction, the mounting spring 28' compresses and the pointed shaft of the nail 20' extends past the mounting spring 28' and through the hole 23'. The nail 20' will continue to extend through until the mounting spring 28' can no longer be compressed or the hammering stops. The cup 26' retains the mounting spring 28' and prevents it from expanding to possibly unmount the nail 20'. From the mounted position, the nail 20' can be pulled by the claw of a hammer in an opposing direction to release the nail 20'.

The upper frame 12' includes a knuckle 13' that is inserted between the knuckles 15' of lower frame 14' that form a hinge when combined. The hinge formed from the upper and lower frames is connected via a pin 32', with the pin 32' being inserted into a spring 34'. The spring 34' biases the lower frame 14' at an angle with respect to the upper frame 12'. As shown in FIG. 5, angling the lower frame 14' creates a spacing between the hook 16' and a wall 8' when the clamp is mounted, so that a siding board can be easily inserted into the hook 16'.

In the embodiment shown in FIG. 5, the hook 16' is a separate component attached to the lower frame 14' in a vertically adjustable position even while the clamp 10' remains mounted. The hook 16' includes a bolt 42' on a face 18' opposing the wall 8 and that is inserted through slot 40' found on the lower frame 14'. The bolt preferably has a rectangular head 42" that fits in slot 40' to prevent rotating the hook with respect to the lower frame, and extends upward of the slot 40'. The slot 40' extends vertically along at least a portion of the lower frame's length. A cap 52' is included to retain the hook 16' on the lower frame 14'. Cap 52' has an inner hole that receives the head 42".

The height of hook 16' may be adjusted by sliding the bolt 42' along the slot 40'. A wingnut 50' or similar fastening mechanism may be used to affix the hook 16' in place. Tightening the wingnut 50' clamps the lower frame 14 between the face 18' and the cap 52'.

The wingnut 50' may be rotated in a first direction to loosen the cap 52' from the lower frame 14' and enable the bolt 42' to slide along the slot 40' to raise or lower the hook 16'. Once the hook 16' is positioned to a desired height, the wingnut 50' may be rotated in an opposing direction to immobilize the cap 52' between the wingnut 50' and lower frame 14' to affix the position of hook 16'. The top and bottom ends of slot 40' function as stops that define the maximum and lowest height that the hook 16' can be adjusted. The length of the slot 40' and lower frame 14' may vary in other embodiments to modify the height range that the hook 16' can be adjusted.

Figure 7:
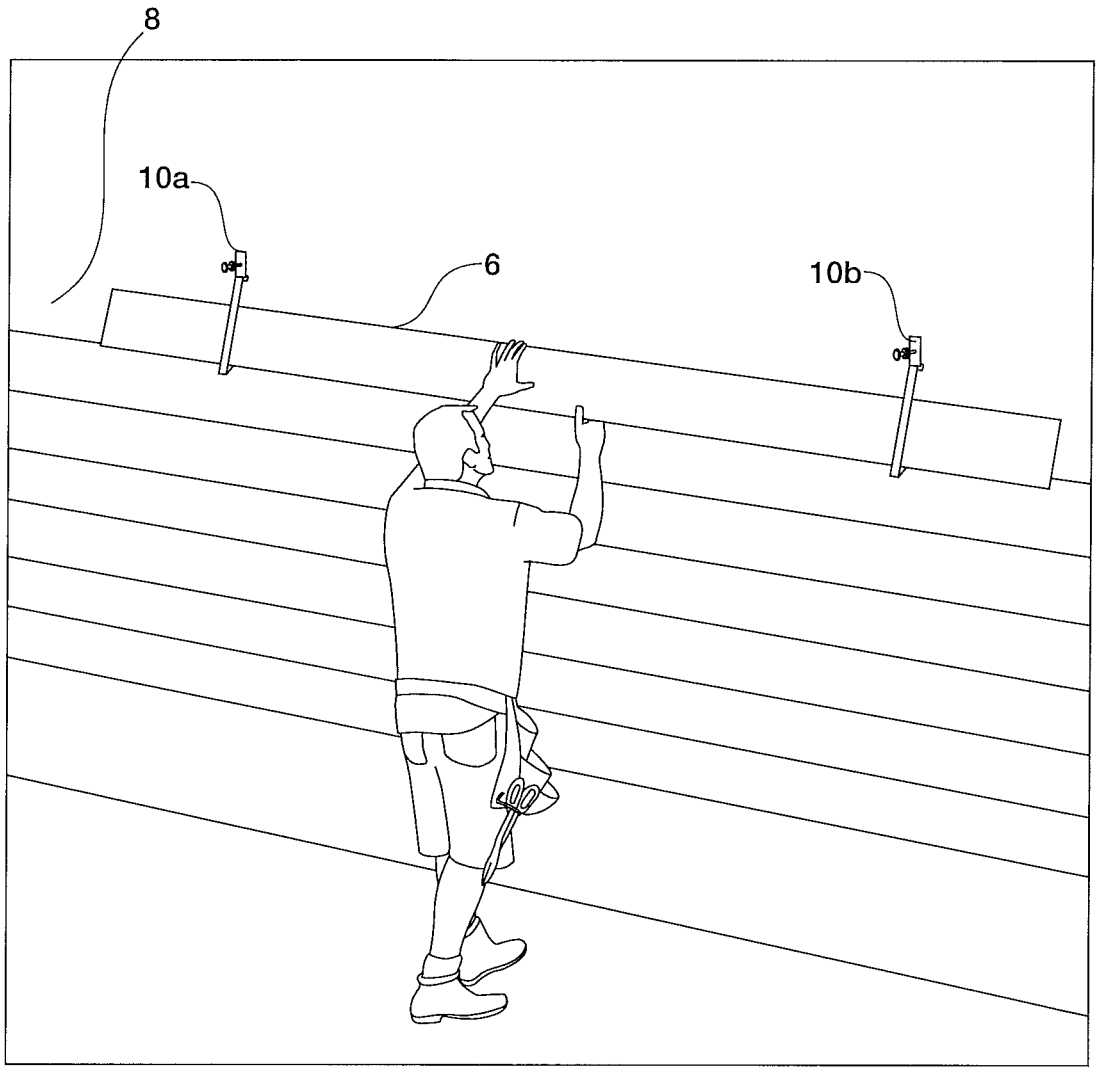
FIG. 7 is a perspective view of a clamp constructed according to one embodiment in use.

In operation, the present invention may also be considered a method for installing siding onto a building. FIG. 7 shows one example of an individual installing siding using two clamps, without requiring the assistance of a second individual. One method for installing siding onto a building includes mounting a first clamp 10*a* and second clamp 10*b* onto the wall 8 of a building. The second clamp 10*b* is mounted some distance away from the first clamp 10*a*; for instance, the distance between the first and second clamps is slightly less than the length of the siding board to be installed.

Before mounting, the position of the hook is preferably adjusted so that it is within the middle of each clamp's slot, so that the hook's position can be lowered or raised if needed without having to unmount the clamp.

In one example using the embodiment of FIGS. 1-3, mounting a clamp onto the wall may comprise hammering a first hammer pad on the clamp to drive a nail into the wall. Similarly, the clamp may be unmounted by hammering a second hammer pad on the clamp to remove the nail from the wall. In another example using the embodiment of FIGS. 4-6, mounting a clamp onto the wall may comprises hammering a head of a nail in a direction to drive the nail into the wall. The clamp may then be unmounted from the wall by pulling the head of the nail in an opposing direction to remove the nail from the wall. First clamp 10*a* and second clamp 10*b* may use the same or different mechanisms for mounting and unmounting.

The desired height of the siding is measured. This may be done before or after any clamps are mounted. Once the desired height is known, the height of the hooks can be adjusted accordingly. For example, the height of the hook may be adjusted by rotating a thumbscrew. In another example, the height of the hook comprises rotating a wingnut in a direction to loosen the hook for height adjustment and rotating the wingnut in an opposite direction to affix the hook at the desired height.

After both hooks match the desired height, the siding 6 is placed onto the hooks of each clamp, and then mounted onto the wall 8. Fine-tuning by adjusting the height of the hook with respect to the lower frame can take place with the siding board in place. Once the siding 6 is nailed in place, the first clamp 10*a* and the second clamp 10*b* may be unmounted from the wall by dislodging the nail. The clamps can then be removed afterwards.

Other tools for installing siding may be cumbersome in operation. For instance, the siding board and/or tool may become locked in position, preventing the user from easily unmounting the siding tool and progressing down the line to install the next siding board. The unique design of the present invention enables users to slide the siding board under the hooks (via the ramp shape of the hook). After the siding board has been partially nailed on, the hooks can be easily removed from the siding board by simply unmounting the nail and sliding the hook down and away from the just installed siding board. Once the siding is installed, the designs of the clamps' mounting mechanisms enable users to easily mount and unmount the clamps on a wall.

Certain modifications and improvements will occur to those skilled in the art upon reading the foregoing description. For example, features of the two embodiments can be used together. That is, the pivoting lever of the first embodiment can be used in a clamp with the hook height adjustment structure of the second embodiment. Such mix-and-match variations are within the scope of the invention. It should be understood that all such modifications and improvements have been omitted for the sake of conciseness and readability, but are properly within the scope of the following claims.

What is claimed is:

1. A clamp for installing a siding onto a building comprising:

an upper frame having a nail for mounting the clamp onto the building and having a lower end, a lower frame having a top end pivotally connected to the lower end of the upper frame and a hook at a lower end of the lower frame, the hook adapted for holding a bottom of the siding, a spring biasing the lower frame with respect to the upper frame to angle the lower frame away from the building, wherein when the clamp is mounted onto the building and the hook is aligned to a position wherein the siding is to be installed, a bottom of the siding may be placed on the hook and thereby be at a suitable height to be mounted onto the building.

2. The clamp of claim 1 further including a bolt on the hook and a slot on the lower frame adapted to receive the bolt, wherein the height of the hook can be adjusted by sliding the bolt along the slot of the lower frame.

3. The clamp of claim 2 further including a stop installed onto the bolt adapted to affix the height of the hook along a position on the slot.

4. The clamp of claim 3, wherein the slot is substantially vertical and spans at least one-fourth of a length of the lower frame.

5. The clamp of claim 3, wherein the stop comprises a wingnut installed onto a set of threadings on the bolt, whereby the height of the hook can be fixed by tightening the wingnut and the height of the hook can be adjusted by loosening the wingnut to move the bolt along the slot of the lower frame.

6. The clamp of claim 3, wherein the stop comprises a thumbscrew fastener inserted through a boss on the lower frame and into a recess on the bolt, whereby the height of the hook can be adjusted by rotating the thumbscrew fastener to move the bolt along the slot of the lower frame.

7. The clamp of claim 6, wherein the thumbscrew fastener is parallel to the slot and the lower frame.

8. A clamp for installing a siding onto a building comprising:

an upper frame having a nail for mounting the clamp onto the building and having a lower end, a lower frame having a top end pivotally connected to the lower end of the upper frame, a spring biasing the lower frame with respect to the upper frame to angle the lower frame away from the building, and a hook connected to a slot in the lower frame enabling the hook to slide along a length of the lower frame for adjusting a height of the hook, wherein when the clamp is mounted onto the building and the hook is aligned to a position wherein the siding is to be installed, the siding may be placed on the hook and thereby be at a suitable height to be mounted onto the building.

9. The clamp of claim 8 further including a lever pivotally mounted onto the upper frame wherein the nail is installed into the lever.

10. The clamp of claim 9 further including a mounting hammer pad on one end of the lever and an unmounting hammer pad on an opposing of the lever, the nail installed underneath the mounting hammer pad, wherein the clamp is adapted to be mounted by hammering the mounting hammer pad to insert the nail into the building and the clamp is adapted to be unmounted by hammering the unmounting hammer pad to remove the nail from the building.

11. The clamp of claim 10, wherein the mounting hammer pad and unmounting hammer pad are comprised of bronze hardened materials.

12. The clamp of claim 8 further including a mounting spring installed onto a head of the nail and spanning down a length of a shaft of the nail onto a receiving cup on the upper frame, wherein the mounting spring is adapted to insert the nail into the building by driving the head of the nail in one direction and adapted to unmount the nail by pulling the head of the nail in the opposite direction.

13. A method of installing a siding onto a wall of a building comprising mounting a first clamp onto the wall by hammering a first hammer pad to drive a nail into the wall, mounting a second clamp onto a wall a distance away from the first clamp, measuring a desired height for the siding, adjusting the height of a hook on the first clamp to match the desired height while the first clamp remains mounted, adjusting the height of a hook on the second clamp to match the desired height and the height of the hook on the first clamp while the second clamp remains mounted, placing a bottom of the siding onto the hooks of the first and second clamps, affixing the siding onto the wall, unmounting the first clamp from the wall by hammering a second hammer pad to remove the nail from the wall, and unmounting the second clamp from the wall.

14. The method of claim 13, wherein mounting the second clamp onto the wall comprises driving a nail into the wall, and unmounting the second clamp from the wall comprises pulling a head of the nail away from the wall.

15. The method of claim 13, wherein adjusting the height of the hook of the first clamp comprises rotating a thumbscrew.

16. The method of claim 13, wherein adjusting the height of the hook of the second clamp comprises rotating a wingnut in a direction to loosen the hook for height adjustment and rotating the wingnut in an opposite direction to affix the hook at the desired height.

* * * * *